US006393720B1

(12) United States Patent
Clark

(10) Patent No.: US 6,393,720 B1
(45) Date of Patent: May 28, 2002

(54) SPREADER APPARATUS FOR PELLET DRYER/COOLER

(75) Inventor: Douglas Clark, Sabetha, KS (US)

(73) Assignee: Wenger Manufacturing, Inc., Sabetha, KS (US)

( * ) Notice: Subject to any disclaimer, the term of this patent is extended or adjusted under 35 U.S.C. 154(b) by 0 days.

(21) Appl. No.: 09/567,177

(22) Filed: May 8, 2000

(51) Int. Cl.[7] ..... F26B 17/12
(52) U.S. Cl. ..... 34/167; 34/172; 239/659
(58) Field of Search ..... 34/165, 166, 167, 34/168, 172, 173, 205, 236; 141/286; 239/659, 663, 689; D15/13; 432/5, 6, 7, 8, 9, 10, 11

(56) References Cited

U.S. PATENT DOCUMENTS 4,934,606 A * 6/1990 Grataloup et al. ..... 239/664
5,022,889 A * 6/1991 Ristvedt et al. ..... 453/6
5,114,078 A * 5/1992 Takata ..... 239/655
5,421,379 A * 6/1995 Geiser ..... 141/1
5,443,539 A * 8/1995 Westelaken ..... 34/370
5,485,963 A * 1/1996 Walto et al. ..... 239/663
5,709,035 A * 1/1998 Wilhelm ..... 34/167
5,815,941 A * 10/1998 Wenger et al. ..... 34/64
5,909,943 A 6/1999 Poirier et al.
5,921,001 A * 7/1999 Hartwig ..... 34/205
6,029,366 A 2/2000 Poirier et al.

* cited by examiner

*Primary Examiner*—Ira S. Lazarus
*Assistant Examiner*—Greg Warder
(74) *Attorney, Agent, or Firm*—Hovey Williams LLP

(57) ABSTRACT

A spreader apparatus (10) designed to evenly spread pellets or the like across an inlet deck (20) of a dryer or cooler is provided which includes a plurality of elongated, telescoping, pivotally supported delivery tubes (12) arranged in side-by-side relationship to form an array (14) extending across the deck (20). A drive assembly (16) is coupled with the tube array (14) so as to sequentially move the array (14) fore and aft to spread product thereon. A distributor (18, 152) is positioned above the array (14) in order to deliver product thereto. The distributor (18) includes a stationary, annular, multiple-pocket tray (76) as well as a spout (98) mounted for 360° rotation about an upright axis. As the spout (98) rotates, successive quantities of product are delivered to each pocket (84) of the tray (76). A ducting assembly (86) is provided between the tray (76) and the upper ends of the tubes (12). In use, as the spout (98) rotates and delivers product to the tray pockets (84), the product descends by gravity into and through the tubes (12). Simultaneously, the tube array (14) is moved across the deck (20) to evenly distribute product on the deck (20). In alternate embodiments, an oscillating spout type distributor 152 is positioned above and coupled with the tube array (14), or the preferred rotary distributor (18) may be used alone for spreading pellets across a conveyor belt (148).

29 Claims, 6 Drawing Sheets

FIG. 2.
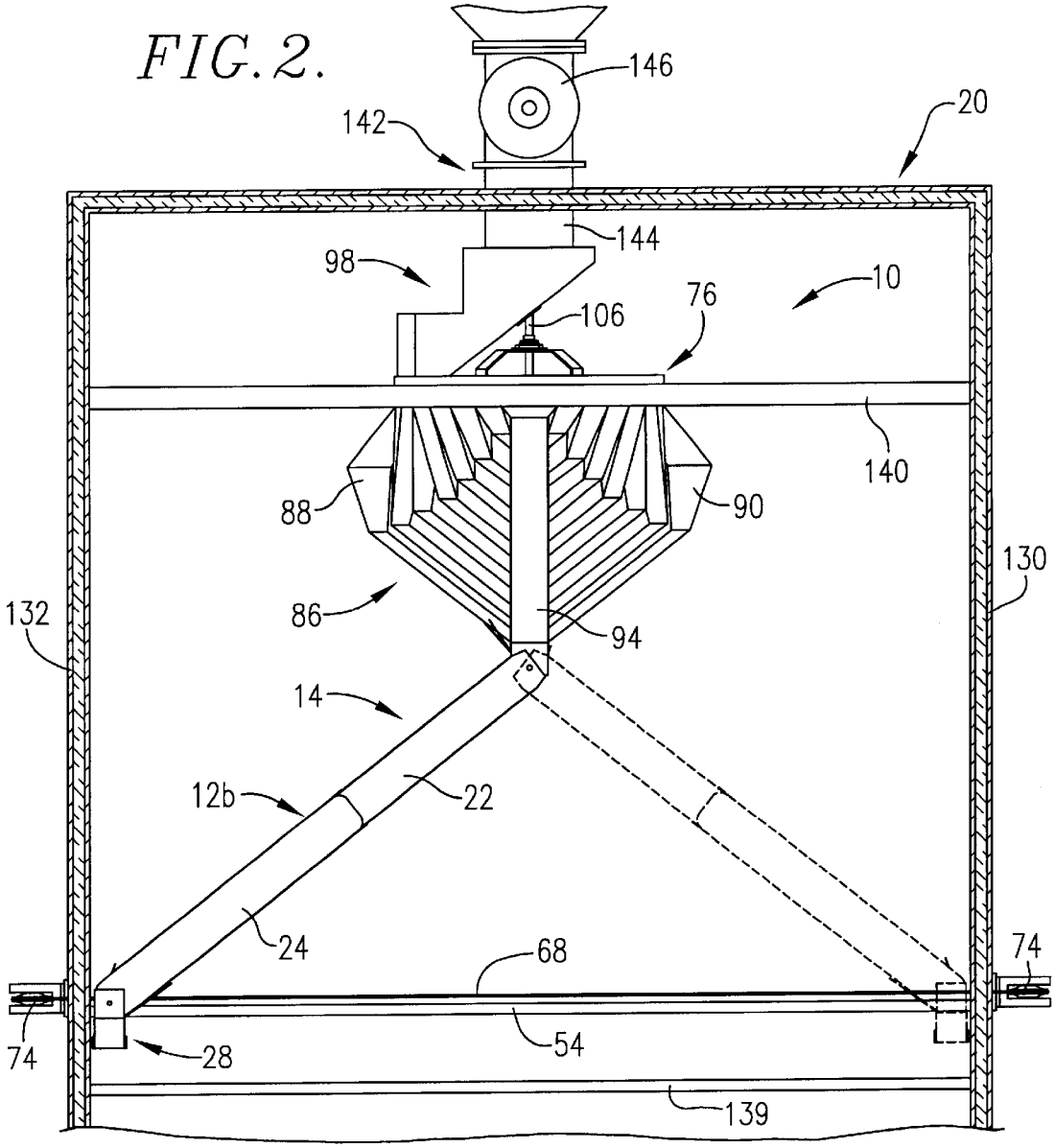
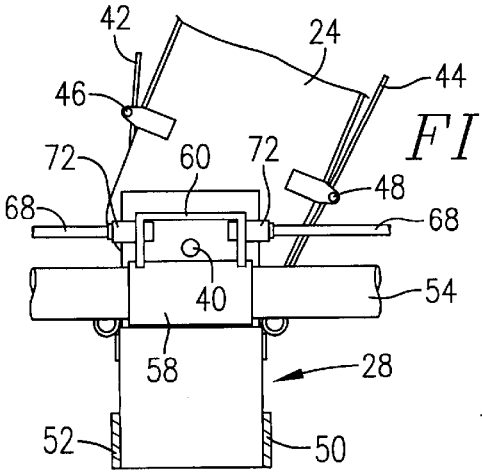
FIG. 7.
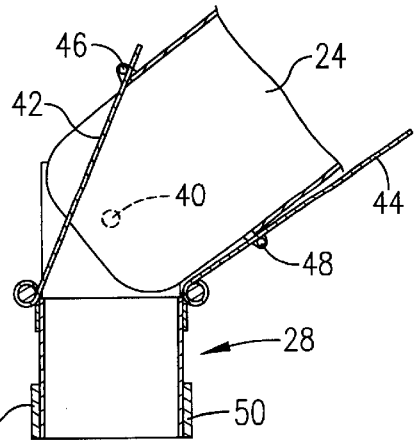
FIG. 8.

SPREADER APPARATUS FOR PELLET DRYER/COOLER

BACKGROUND OF THE INVENTION

1. Field of the Invention

The present invention is broadly concerned with improved spreader apparatus designed for use in square or rectangular inlet decks forming a part of pellet dryers or coolers, in order to evenly spread product to a desired depth on the deck. More particularly, the invention pertains to such spreader apparatus and complete dryer/cooler inlet decks, wherein use is made of spreader including a plurality of elongated delivery tubes driven in unison across the deck for distribution of product thereon. In alternate embodiments, a rotating spout distributor is used to spread product on a conveyor belt or the like.

2. Description of the Prior Art

It is a common requirement in numerous bulk material processes to dry and/or cool a product at some intermediate or final stage of production. For example, in extrusion processing of animal feeds or the like, the extrudate emerges from the extruder at an elevated temperature and at relatively high moisture levels. In order to more readily handle the product and to assure its shelf life, it is generally necessary to dry and cool the extrudate to room temperature and moisture levels of perhaps 8–12% by weight.

In many extrusion systems therefore, dryer/cooler apparatus is provided downstream of the extruder so that the extrudate is dried and cooled on a continuous basis. A variety of different dryers or coolers have been used in this context, for example vertical dryers or other types of upright dryers with continuous air flow therethrough. Such dryers have a square or rectangular inlet stage or deck where incoming product is received. In order to achieve the best and most efficient drying/cooling results, it is important that the incoming product be evenly spread over the inlet deck. If not, the product may be unevenly dried or cooled during passage through the dryer/cooler.

A number of expedients have been used in the past in an attempt to evenly spread incoming pelleted or similar products across the square or rectangular inlet decks. A common approach is to simply dump product onto the deck using a rotating spout and then make use of a rotatable rake to spread and even the product. The problem with rakes is that they cannot spread product in the corners of the deck. Thus, while the central region of the deck described by rake rotation is evenly spread, the product in the corners will either be at a level higher or lower than the central region.

Another approach is described in U.S. Pat. Nos. 5,909,943 and 6,029,366. These patents make use of an oscillating inlet spreader including an elongated delivery spout which is driven through a range of motion in an effort to evenly spread pellets across a dryer/cooler deck. A specialized outlet grate is also provided with the spreader in a further effort to uniformly spread product. Level detectors and a variable frequency drive are also used. Consequently, spreaders as disclosed in these references are excessively complex and costly.

There is accordingly a real and unsatisfied need in the art for improved spreader apparatus designed to be used as a part of dryer/cooler inlet deck arrangements in order to provide essentially uniform spreading of pellets or like products across the entirety of an inlet deck.

SUMMARY OF THE INVENTION

The present invention overcomes the problems outlined above and provides spreader apparatus for use in inlet decks and the like. Broadly speaking, in a preferred embodiment, the spreader apparatus includes a plurality of elongated delivery tubes with outlet ends above an inlet deck, with a drive assembly coupled with the delivery tubes so as to successively move the tubes relative to the deck in order that essentially the entire product-receiving area of the deck is traversed by the delivery tube ends. A distributor is located above the delivery tubes for delivery of quantities of pellets or the like to each of the tubes. In this fashion, the pellets may be evenly spread through appropriate correlation of the volume of pellets delivered to the tubes and the rate of movement thereof over the inlet deck. Alternately, the spreader includes an annular, multiple-pocket tray together with a shiftable spout located above the tray for successive delivery of pellets to the tray pockets. A series of delivery ducts are located below the annular tray and are in communication with the pockets thereof. The delivery ducts deliver product to a conveyor belt or like device.

In preferred forms, where use is made of the delivery tubes, they are arranged in side-by-side relationship and are connected to form a tube array which extends substantially across the width of the inlet deck. Each of the delivery tubes includes a pair of telescopically interfitted upper and lower sections, with a pivotally coupled delivery shoe secured to the bottom ends of the lower tube sections. The upper tube sections are pivotally connected to and supported by the distributor, which advantageously includes a circular, multiple-pocket tray and a rotating spout to successively deliver product to each tray pocket. A ducting assembly is provided between the tray and the upper ends of the delivery tubes. The preferred drive assembly includes a drive cable arrangement which can be moved fore and aft in order to correspondingly move the drive delivery tube array along the length of the inlet deck. An alternate distributor includes an elongated trough positioned above the upper ends of the delivery tubes, together with an oscillating spout which fills the trough during operation.

BRIEF DESCRIPTION OF THE DRAWINGS

FIG. 2 is a vertical sectional view illustrating a pellet dryer/cooler inlet deck equipped with the preferred spreader apparatus, and illustrating in full line and phantom the extent of movement of the delivery tube array across the inlet deck;

FIG. 7 is a fragmentary side view illustrating in detail the preferred carriage arrangement forming a part of the drive assembly;

FIG. 8 is a fragmentary vertical sectional view showing the pivotal interconnection of the lower end of a delivery tube to an outlet shoe;

DETAILED DESCRIPTION OF THE PREFERRED EMBODIMENT

Figure 1:
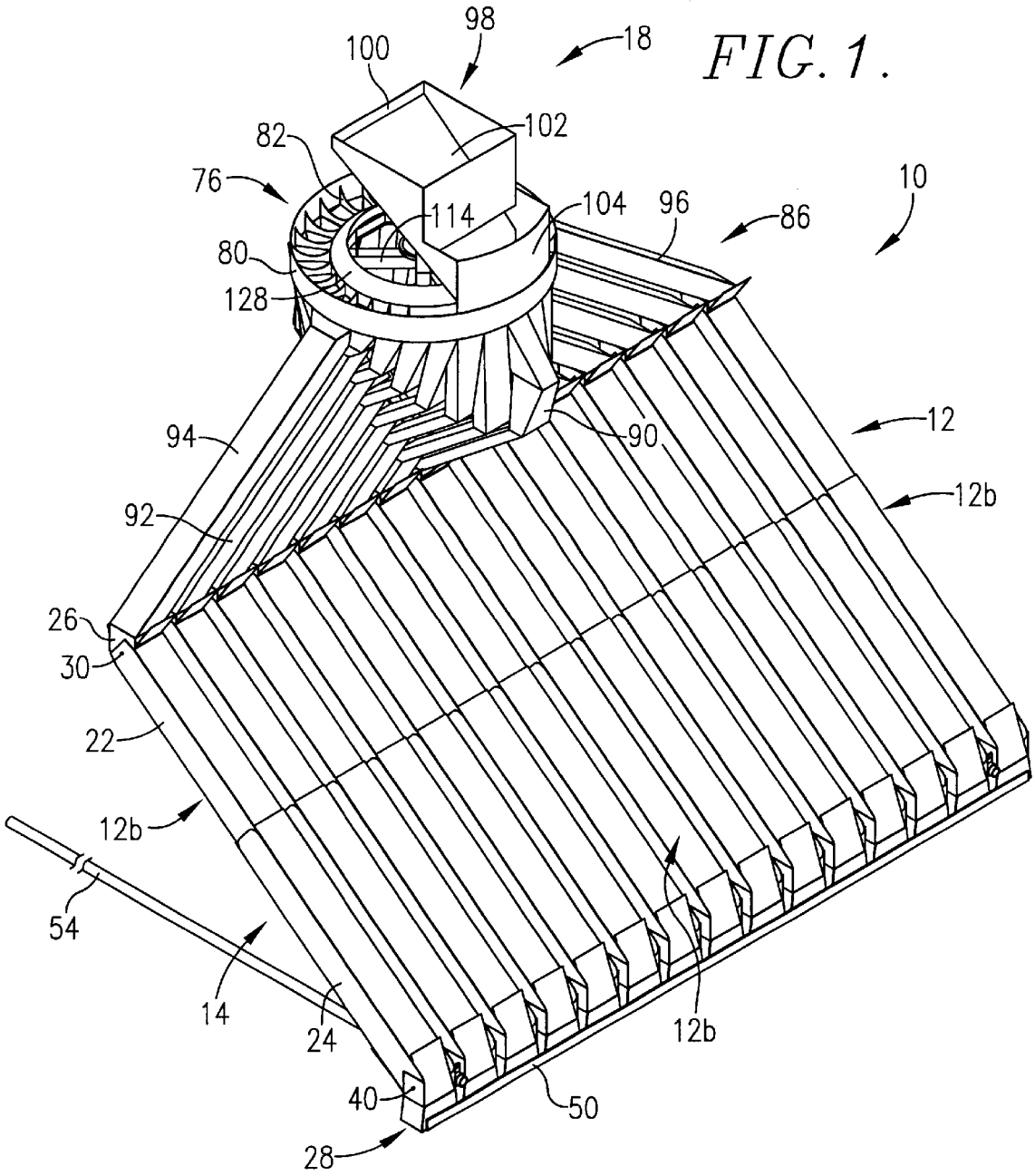
FIG. 1 is an isometric view of the preferred spreader apparatus of the invention, depicting the delivery tube array and the distributor structure therefor.

Turning now to the drawings, a spreader apparatus 10 in accordance with the invention broadly includes a plurality of elongated delivery tubes 12 preferably located in side-by-side relationship and interconnected to form a tube array 14, a drive assembly 16 associated with the array 14 for movement of the latter during operation, and a distributor 18 located above the array 14 and operable to deliver quantities of discrete bodies such as pellets to the upper ends of the tubes 12, whereby such bodies pass downwardly through the tubes 12 for delivery. The apparatus 10 is especially designed for use in an inlet deck 20 of a pellet dryer/cooler, and serves to substantially evenly spread pellets or the like to be dried across the deck in a uniform fashion.

Figure 6:
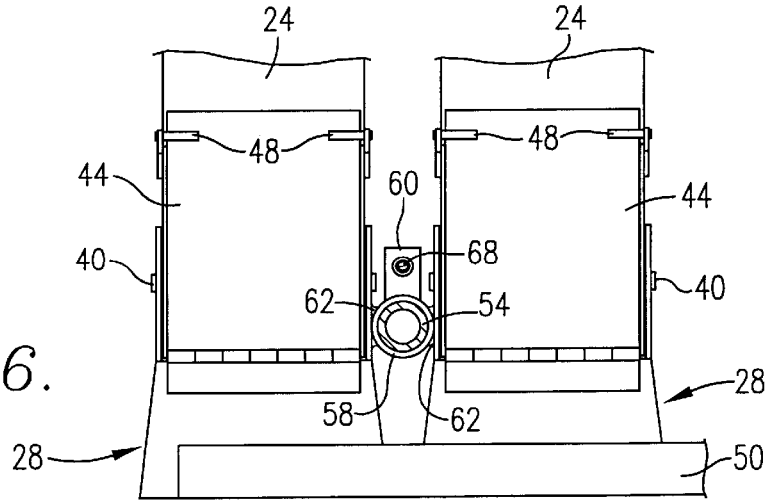
FIG. 6 is a fragmentary vertical sectional view illustrating the interconnected delivery ends of the delivery tube array, and portions of the drive assembly for the tube array.

In more detail, each delivery tube 12 includes an upper tubular section 22 slidingly telescoped within a lower tubular section 24. Each upper section 22 is pivotally coupled to an associated down spout 26 (see FIG. 4) forming a part of the distributor 18. Each lower section 24 is equipped with a pivotally movable tubular shoe 28 as best seen in FIGS. 6–8.

In detail, each upper section 22 is connected to its associated down spout 26 by means of a pivot crosspin 30. In addition, each such section 22 has a pair of opposed, deflector plates 32, 34 pivotally mounted adjacent the uppermost end thereof and extending upwardly. The down spout 26 has two pairs of opposed, outwardly extending plate guides 36, 38 on opposite sidewalls thereof which engage a corresponding deflector plate 32 or 34. The guides 36, 38 permit the deflector plates to slide relative to the down spout 26 during pivoting of the underlying tube 12 as will be described. The deflector plates assure that during such pivoting, pellets from the down spout 26 are directed downwardly through the tube 12.

The shoes 28 are connected to the associated lower tubular sections 24 in a similar manner. Specifically, each tubular shoe 28 is supported on a crosspivot pin 40 provided adjacent the lower end of each section 24. Further, a pair of opposed lower deflector plates 42, 44 are pivotally coupled to opposed sidewalls of the shoe 28 and extend upwardly therefrom. Each such deflector plate 42, 44 is captively and slidingly received by opposed, outwardly extending pairs of plate guides 46, 48 provided on opposed sidewalls of the lower tubular section 24. Again, during relative pivoting between the tubular sections 24 and shoes 28, the plates 42, 44 assure that product passing from the sections 24 passes unimpededly through the shoes 28 for ultimate delivery.

The shoes 28 are interconnected adjacent their lower outlet ends by means of a pair of elongated connector strips 50, 52 which are welded to the respective shoes 28 and extend in spanning relationship across the array 14.

Figure 3:
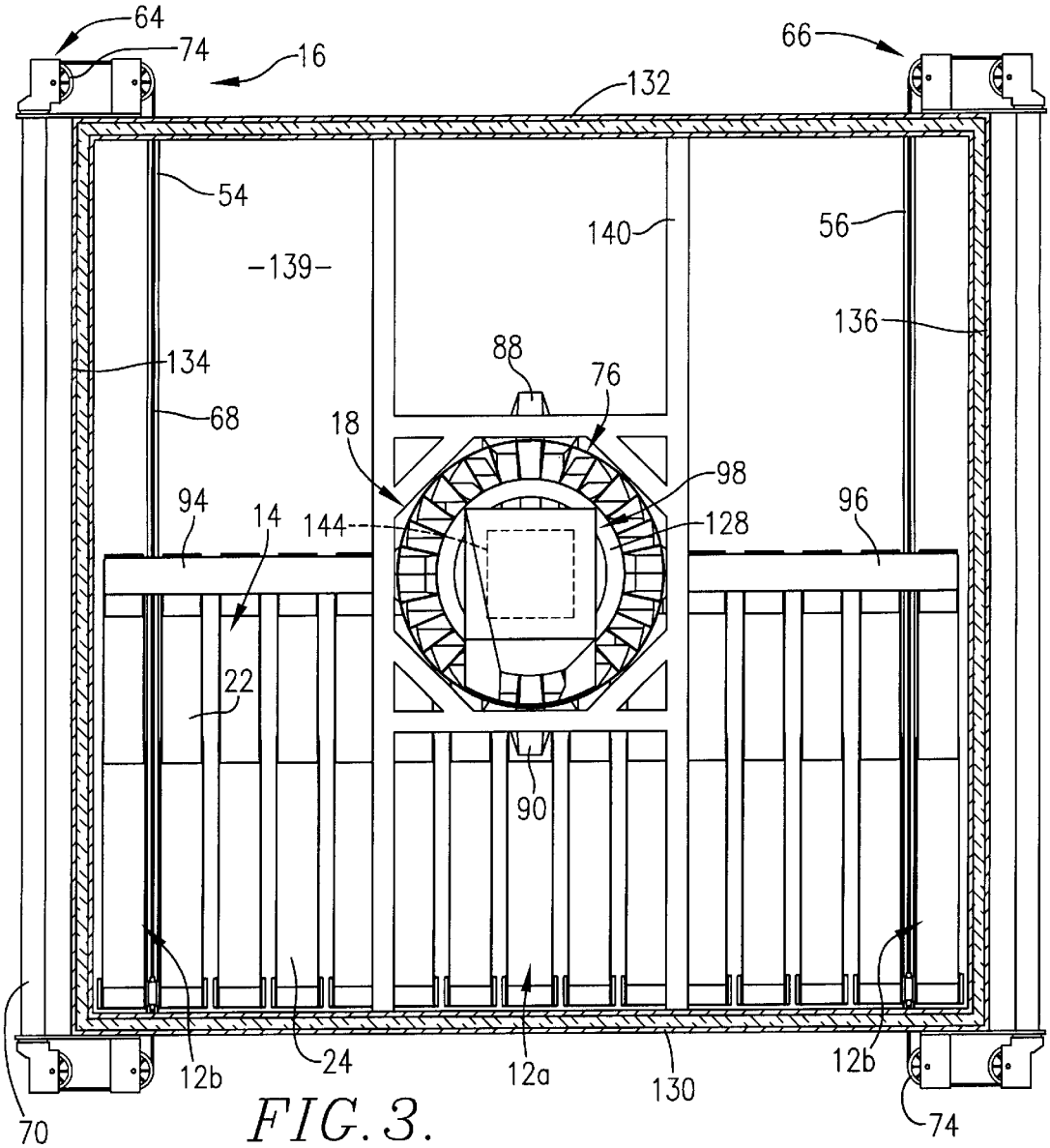
FIG. 3 is a plan view of the deck depicted in FIG. 2 and illustrating the construction of the spreader apparatus.

The drive assembly 16 is designed to smoothly and uniformly move the tube array in an alternating, fore and aft manner across the floor of deck 28. As best seen in FIGS. 3, 6 and 7, the assembly 16 includes a pair of elongated, parallel stationary guides 54, 56 which are permanently connected to the walls of deck 20. Each guide 54, 56 supports an annular, axially shiftable carriage 58 having an upstanding connection bight 60. As best seen in FIG. 6, the carriage 58 is located between a pair of shoes 28 and is welded to each adjacent shoe 28 as at 62. Finally, the assembly 16 includes a pair of cable drive units 64, 66 respectively associated with a corresponding guide 54, 56 and its associated carriage 58. Each unit 64, 66 includes a pair of elongated drive cables 68, the ends of which are connected to a conventional linear actuator 70 and to opposite ends of the associated connection bight 60. As illustrated in FIG. 7, the ends of cables 68 are dead-ended to the bight 60 by conventional couplers 72. The opposite ends of these cables 68 are similarly connected to the actuator 70. As best seen in FIG. 3, the cables 68 are appropriately trained around end-mounted guide pulleys 74. As will be readily understood, operation of the actuators 70 in alternate fore and aft directions will, through the medium of drive cables 68, shift the carriages 58 and thus the entire tube array 14.

Figure 4:
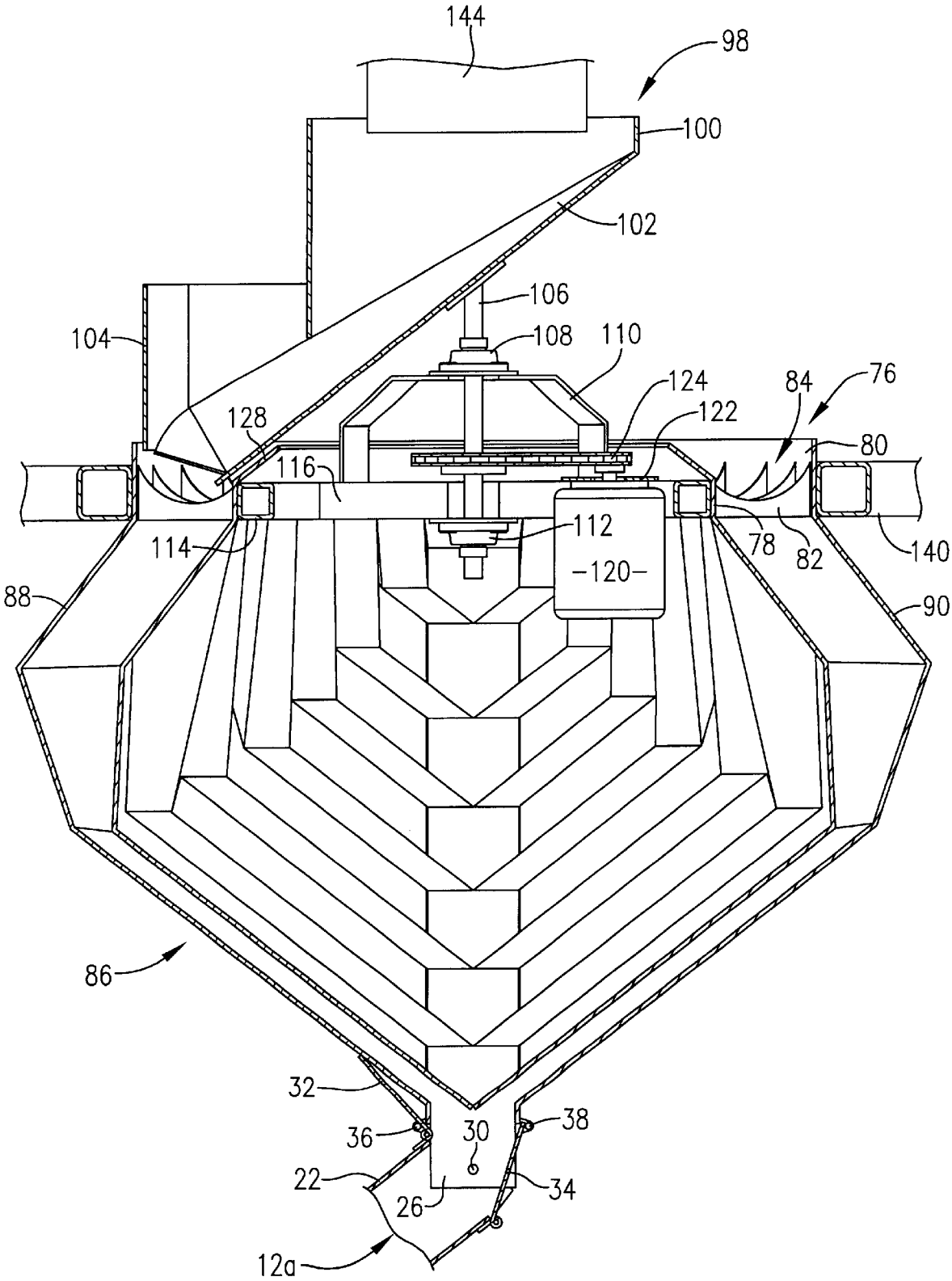
FIG. 4 is a vertical sectional view depicting the construction of the distributor structure of the spreader apparatus.
Figure 5:
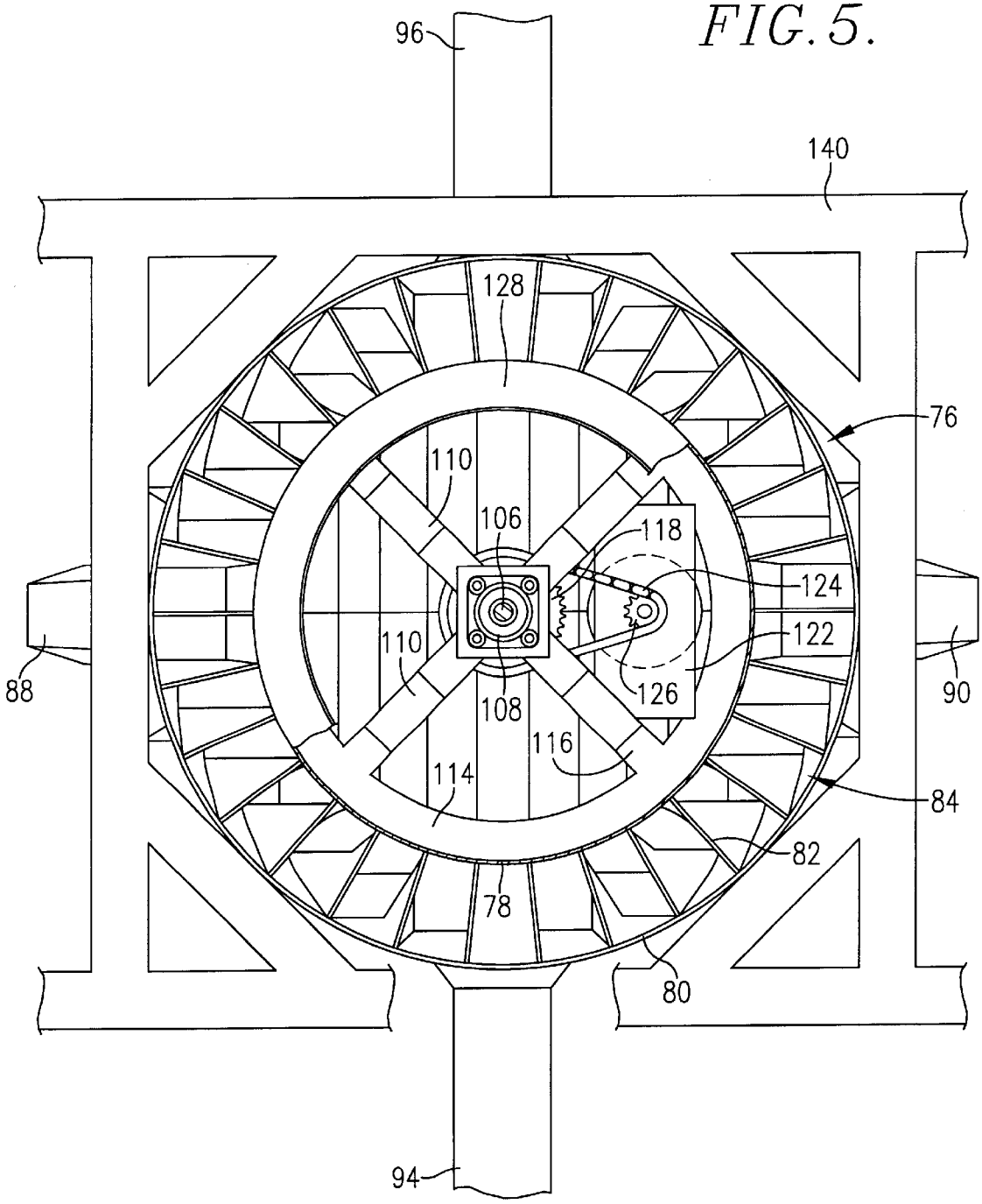
FIG. 5 is a fragmentary top view of portions of the distributor structure, but with the rotating spout removed to illustrate the internal construction thereof.

The distributor 18 includes an upper, multiple-pocketed annular tray 76 positioned above the tube array 14. In the embodiment shown, the tray 76 has concentric inner and outer circular walls 78 and 80, with a total of thirty generally radially extending, circumferentially spaced pocket walls 82 extending between and interconnected to the circular walls 78, 80. In this fashion, a total of thirty individual, open-bottom pockets 84 are defined by the tray 76. In the illustrated embodiment, the tube array 14 is made up of fifteen side-by-side delivery tubes 12. Two of the pockets 84 of the tray 76 are connected to each of the tubes 12 for delivery of pellets thereto. In particular, a spider-type ducting assembly 86 is provided between the bottom of tray 76 and the upper ends of the sections 22 of the tubes 12 for this purpose. As best illustrated in FIGS. 1 and 4, a pair of opposed, oppositely extending dog leg ducts 88, 90 extend from the bottom of tray 76 downwardly and converge at the down spout 26. The upper ends of each of the ducts 88, 90 are in communication with opposed tray pockets 84. Thus, pellets or the like fed to the pockets 84 pass downwardly through the ducts 88, 90 for passage through the spout 26 and ultimately into the central delivery tube 12*a*. In a similar fashion, differently configured pairs of dog leg ducts are positioned in communicate with associated pairs of opposed tray pockets 84. Given that the remaining delivery tubes are located outwardly of the central delivery tube 12*a*, obliquely oriented lateral transition ducts 92 are provided between the lower ends of the dog leg ducts and the upper ends of the associated delivery tubes 12. For example, the outermost delivery tubes 12*b* are coupled to the tray 76 by means of oblique lateral transition ducts 94, 96 to the tray 76.

A rotating spout 98 is located above the tray 76 and has an upper inlet end 100, an oblique central section 102, and a lowermost outlet 104. The spout 98 is designed to rotate about tray 76 with the outlet end 104 thereof directly above the pockets 84, i.e., between the tray walls 78, 80. For this purpose, the tray is mounted on an upright central shaft 106. The shaft 106 is supported by bearings 108 mounted on cross-members 110, and by lower bearings 112. The cross-members 110 and bearings 112 are supported on a circular tray frame 114 which has diagonal crosslegs 116. The shaft 106 also supports a sprocket 118. A drive motor 120 is also supported on the frame 114 by means of a mounting plate 122 secured thereto. A drive chain 124 is trained about the output sprocket 126 of motor 120 and the sprocket 118. Therefore, actuation of motor 120 serves to rotate shaft 106 and thus spout 98 about a central vertical axis. In order to assure smooth rotation of the spout, an annular shroud 128 extends upwardly from the circular frame 114 to a point just below the underside of the spout 98 (see FIG. 4).

The inlet deck 20 is designed to receive pellets or the like to be cooled. The deck has upstanding, insulated end walls 130, 132, sidewalls 134, 136, and top wall 138, thereby defining a box-like structure which is typically either square or rectangular in plan configuration. Floor 139 of the deck 20 is constructed so that it can be opened to allow product to descend from the inlet deck for subsequent processing within the dryer/cooler. Such floor operation may be relatively continuous to provide a "dribble" of product, or it may be opened from time to time to provide successive charges of pellets, as in the case of a continuous batch-type dryer/cooler. The spreader apparatus 10 is mounted within the deck 20, being supported therein by means of a conventional H-type frame 140 extending between and connected with the end walls 130, 132. A product inlet assembly 142 is positioned above top wall 138 and includes a delivery pipe 144 extending through top wall 138 and into the confines of the inlet end 100 of spout 98. The assembly 142 also typically includes a rotatable airlock 146.

The purpose of spreader assembly 10 is to evenly spread pellets or the like across the entire length and width of the deck 20. Accordingly, the array 14 is designed to have a sufficient number of delivery tubes 12 to extend essentially the full length of the deck 20 between the sidewalls 134, 136. Furthermore, the drive assembly 16 is constructed so as to move the tube array 12 essentially the full length of the deck 20 between the end walls 130, 132.

When the array 14 is in the position illustrated in FIG. 3 with the delivery shoes 28 adjacent end wall 130, it is ready to be moved to a point opposite, adjacent the end wall 32. This is accomplished by operation of the linear actuators 70 to in turn pull the cables 68 so that the carriages 58 slide along the length of the guides 54, 56. As this occurs, the array 14 is moved towards the end wall 132. During such movement, the telescoping construction of the delivery tubes 12 accommodates the movement, contracting as the tubes near the center of the deck 139, and then extending again as the tubes move towards the wall 132. Furthermore, as this motion occurs, the upper and lower deflector plate pairs 32, 34 and 42, 44 shift within their associated guides 36, 38 46, 48 to assure that product smoothly passes from the ducting assembly 86 through the tubes 12 and ultimately out the ends of the shoes 28. Referring to FIG. 8 for example, it will be seen that as relative pivoting movement occurs between each tube section 24 and its associated shoe 28, the plate 42 covers the otherwise open end of the section 24 to prevent passage of product out of this open end. Similarly, when opposite relative pivotal movement occurs, the plate 44 extends over the open end of the section 24.

Of course, during the fore and aft movement of the tube array 14, pellets are continually being delivered to the tubes via the distributor 18. This involves passage of pellets from delivery pipe 144 into spout 98. The spout is simultaneously rotated as explained, whereby pellets are successively delivered to each of the individual pockets 84 of the tray 76. Such pellets then descend under the influence of gravity through the ducting assembly 86 into the delivery tubes 12.

Typically, the spout is rotated at a rate of perhaps 20–60 rpm, the precise speed being dependent upon the size of the dryer/cooler. The tube array 14 can be operated at various rates, and may make a sweep across the deck 14 every minute or so. Of course, the spout rotational speed and the fore and aft traversal speed of the array 14 are dependent upon dryer size and the depth of product desired within the deck 20.

While a preferred embodiment of the invention has been described herein, it will be appreciated that many changes and alterations can be made without departing from the principles of the invention. Thus, while rectangular in cross-section delivery tubes are illustrated, circular tubes could be employed. Moreover, the arrangement of tray 76 and ducting assembly 86 can be changed as necessary to provide the desired product flow through the spreader apparatus.

Figure 9:
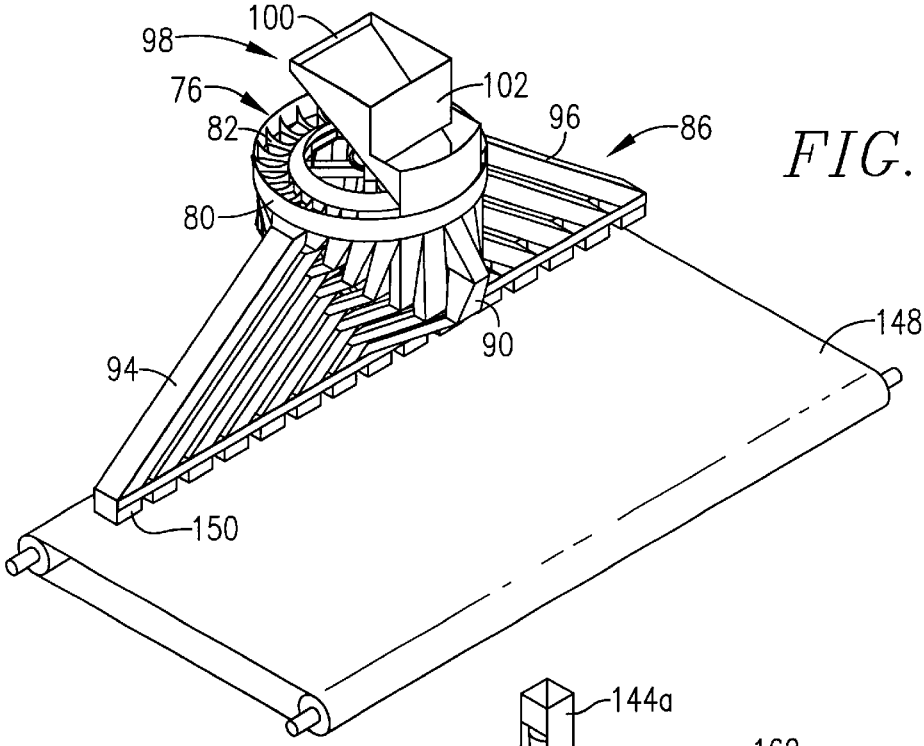
FIG. 9 is an isometric view of another embodiment of the spreader apparatus of the invention, employing the distributor of the FIGS. 1–8 embodiments to distribute pellets over a conveyor belt or the like, without the provision of the delivery tubes.

FIG. 9 illustrates an alternative spreader in accordance with the invention, which is particularly adapted for delivery of pellets or the like across the width of a conveyor belt 148. In this embodiment, use is made of the preferred rotary distributor 86, and accordingly like reference numerals have been applied to the distributor components illustrated in FIG. 9. In this instance, the ends of the delivery ducts are provided with stationary outlets 150 directly above the belt 148. In all other respects, the distributor 86 is identical to that described in connection with the embodiments of FIGS. 1–8. The FIG. 9 arrangement allows even spreading across the inlet conveyor belt of a horizontal dryer, and avoids problems which are sometimes associated with oscillating spouts.

Figure 10:
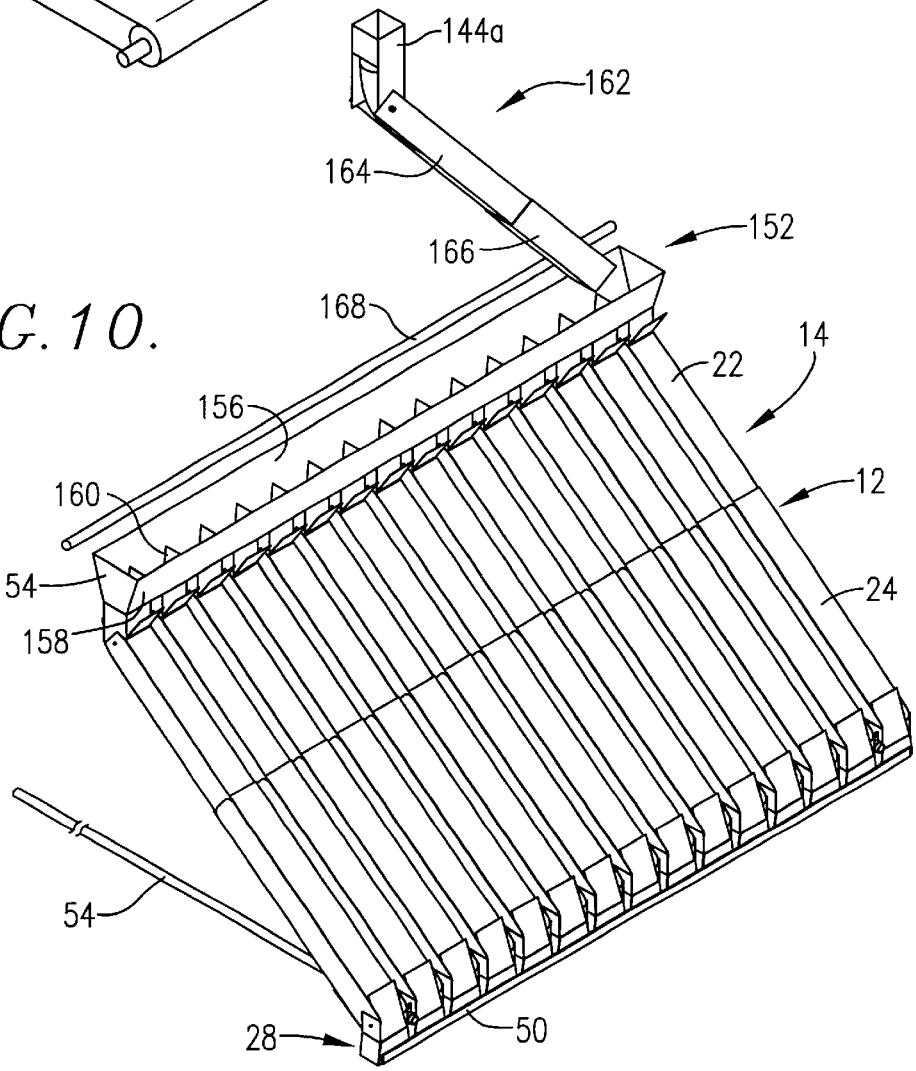
FIG. 10 is an isometric view of a third embodiment of the spreader apparatus, making use of an array of telescopic delivery tubes but employing an oscillating feeder with a trough coupled to the upper ends of the delivery tubes.

FIG. 10 illustrates a further embodiment wherein use is made of a different distributor 152 above the tube array 14. That is, the tube array 14 is identical with that described previously, but is connected to an elongated trough 154 presenting upstanding, diverging sidewalls 156, 158, with an open bottom. A series of upright, laterally spaced apart inner walls 160 are located along the length of the trough 154 to divide the latter into individual pockets or compartments which are aligned with the individual delivery tubes 12 of the array 14. In addition, the distributor 152 includes an oscillating spout 162 made up of telescopically interfitted tubular components 164, 166. The upper end of the spout 62 is pivoted to a delivery pipe 144*a* which is similar to the previously described pipe 144 and extends through the top wall of the cooler or dryer (not shown). The spout 162 is thus pivotal about a generally horizontal axis transverse to the longitudinal axis of the trough 154. The spout 162 is shifted along the length of the trough 154 by means of a guide 168 functionally identical to the previously described guide 54; a slide carriage (not shown) is coupled to the lower end of the spout 162 for movement along the length of guide 168. Finally, a drive assembly (not shown) is coupled to the slide carriage for movement of the spout as described. The drive assembly is conveniently a linear actuator/cable drive such as the drives 16 described previously.

It will also be appreciated that a number of further alterations could be made in the preferred embodiments without departing from the principles of the invention. For example, the various mechanical joints described could be replaced with flexible conduits. Similarly, while telescoping delivery tubes 12 and spout 162 are preferred, use could also be made of accordion-style flexible tubes.

I claim:

1. A spreader apparatus for spreading discrete bodies in a device for cooling and/or drying of the bodies, said spreading being in a generally uniform fashion across an area, said apparatus comprising:

a plurality of elongated delivery tubes each presenting an upper end and a lower delivery end adjacent said area of said device;

a drive assembly operably coupled with said tube delivery ends in order to selectively move said ends across said area of said device; and a distributor located adjacent the upper ends of said tubes in order to deliver quantities of said discrete bodies to each of said tube upper ends whereby the body quantities passed downwardly through the tubes for delivery to said area through said delivery ends.

2. The apparatus of claim 1, each of said tubes being pivotally coupled with said distributor.

3. The apparatus of claim 1, each of said delivery tubes comprising a pair of telescopically interfitted tubular sections.

4. The apparatus of claim 1, each of said lower delivery ends being pivotally coupled to a corresponding delivery tube.

5. The apparatus of claim 1, said tubes being in side-by-side relationship and interconnected to define a tube array, said drive being connected to said tube array for shifting of said tubes in unison across said area.

6. The apparatus of claim 5, said drive assembly comprising:

an elongated stationary guide;

a carriage on said guide and shiftable therealong; and a drive cable coupled with said carriage and movable in opposite directions for selective movement of the carriage and thereby movement of said tube array.

7. The apparatus of claim 1, said distributor comprising:

a delivery tray presenting a series of tray openings each in communication with a corresponding tube upper end; and a spout presenting an inlet end and a movable outlet end, said spout outlet end oriented adjacent said tray in order to deliver bodies to each tray opening during relative movement between the spout outlet end and said tray.

8. The apparatus of claim 7, said delivery tray being stationary and of annular configuration, there being a plurality of generally radially oriented, circumferentially spaced walls defining said tray openings.

9. The apparatus of claim 7, said spout being rotatable about an upright axis.

10. The apparatus of claim 1, said distributor comprising an elongated trough operably coupled with the upper ends of said tubes, and a shiftable delivery spout above said trough for delivery of said discrete bodies to the trough.

11. The apparatus of claim 10, said spout being pivotal about a horizontal axis transverse to the axis of said trough.

12. The apparatus of claim 10, said delivery spout comprising a pair of telescopically interfitted sections.

13. A pellet dryer/cooler inlet deck comprising:

upright walls defining said deck and an area thereon for receiving pellets to be dried and/or cooled;

spreader apparatus above said pellet-receiving area of said deck operable to substantially uniformly spread pellets across said area, said spreader apparatus comprising a plurality of elongated delivery tubes each presenting an upper end and a lower delivery end adjacent said area of said deck;

a drive assembly operably coupled with said tube delivery ends in order to selectively move said ends across said area of said deck; and a distributor located adjacent the upper ends of said tubes in order to deliver quantities of said discrete bodies to each of said tube upper ends whereby the body quantities passed downwardly through the tubes for delivery to said area through said delivery ends.

14. The dryer/cooler deck of claim 13, each of said tubes being pivotally coupled with said distributor.

15. The dryer/cooler deck of claim 13, each of said delivery tubes comprising a pair of telescopically intermitted tubular sections.

16. The dryer/cooler deck of claim 13, each of said lower delivery ends being pivotally coupled to a corresponding delivery tube.

17. The dryer/cooler deck of claim 13, said tubes being in side-by-side relationship and interconnected to define a tube array, said drive being connected to said tube array for shifting of said tubes in unison across said area.

18. The dryer/cooler deck of claim 17, said drive assembly comprising:

an elongated stationary guide;

a carriage on said guide and shiftable therealong; and a drive cable coupled with said carriage and movable in opposite directions for selective movement of the carriage and thereby movement of said tube array.

19. The dryer/cooler deck of claim 13, said distributor comprising:

a delivery tray presenting a series of tray openings each in communication with a corresponding tube upper end; and a spout presenting an inlet end and a movable outlet end, said spout outlet end oriented adjacent said tray in order to deliver bodies to each tray opening during relative movement between the spout outlet end and said tray.

20. The dryer/cooler deck of claim 19, said delivery tray being stationary and of annular configuration, there being a plurality of generally radially oriented, circumferentially spaced walls defining said tray openings.

21. The dryer/cooler deck of claim 19, said spout being rotatable about an upright axis.

22. The dryer/cooler deck of claim 13, said walls defining a substantially square or rectangular area with a pair of opposed sidewalls, said tubes located in side-by-side relationship to present a tube array, said tube array substantially completely extending between said sidewalls.

23. The dryer/cooler deck of claim 13, said deck also including a top wall disposed above and spanning said upright walls, there being a tubular pellet inlet extending through said top wall and communicating with said distributor in order to deliver said bodies thereto.

24. The dryer/cooler deck of claim 13, said distributor comprising an elongated trough operably coupled with the upper ends of said tubes, and a shiftable delivery spout above said trough for delivery of said discrete bodies to the trough.

25. The dryer/cooler deck of claim 24, said spout being pivotal about a horizontal axis transverse to the axis of said trough.

26. The dryer/cooler deck of claim 24, said delivery spout comprising a pair of telescopically interfitted sections.

27. A spreading apparatus for spreading discrete bodies in a generally uniform fashion across the width of an elongated belt forming a part of a device for cooling and/or drying of the bodies, said apparatus comprising:

a delivery tray presenting a series of tray openings;

a spout presenting an inlet end and a movable outlet end, said spout outlet end oriented adjacent said tray in order to deliver bodies to each tray opening during relative movement between the spout outlet end and said tray; and a plurality of delivery ducts located below said tray and respectively in communication with at least one of said tray openings, said delivery ducts including corresponding outlets positioned above said belt forming a part of said device.

28. The apparatus of claim 27, said delivery tray being stationary and of annular configuration, there being a plurality of generally radially oriented, circumferentially spaced walls defining said tray openings.

29. The apparatus of claim 27, said spout being rotatable about an upright axis.

* * * * *